US008900425B2

(12) United States Patent
Harris et al.

(10) Patent No.: US 8,900,425 B2
(45) Date of Patent: Dec. 2, 2014

(54) CONTACT RING FOR AN ELECTROCHEMICAL PROCESSOR

(75) Inventors: Randy A. Harris, Kalispell, MT (US); Paul R. McHugh, Kalispell, MT (US); Gregory J. Wilson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 285 days.

(21) Appl. No.: 13/306,666

(22) Filed: Nov. 29, 2011

(65) Prior Publication Data

US 2013/0134035 A1 May 30, 2013

(51) Int. Cl.
*C25D 17/06* (2006.01)
*C25D 17/00* (2006.01)

(52) U.S. Cl.
CPC ..... *C25D 17/007* (2013.01); *C25D 17/001* (2013.01)
USPC ..... 204/242; 204/297.1

(58) Field of Classification Search
CPC ..... C25D 7/12; C25D 7/123; C25D 7/126; C25D 17/005; C25D 17/06; C25D 17/08; C25D 17/00; C25D 17/001
USPC ..... 204/297.06–297.14; 205/157
See application file for complete search history.

(56) References Cited

U.S. PATENT DOCUMENTS

| | | | |
|---|---|---|---|
| 6,139,712 | A | 10/2000 | Patton et al. |
| 6,156,167 | A | 12/2000 | Patton et al. |
| 6,436,249 | B1 | 8/2002 | Patton et al. |
| 6,527,925 | B1 | 3/2003 | Batz |
| 6,562,204 | B1 | 5/2003 | Mayer et al. |
| 6,589,401 | B1 | 7/2003 | Patton et al. |
| 6,773,560 | B2 | 8/2004 | Pedersen |
| 6,911,127 | B2 | 6/2005 | Batz, Jr. et al. |
| 6,962,649 | B2 | 11/2005 | Wilson |
| 7,267,749 | B2 | 9/2007 | Wilson |
| 7,645,366 | B2 * | 1/2010 | Hanson et al. ..... 204/297.08 |
| 7,935,231 | B2 | 5/2011 | Ghongadi et al. |
| 7,985,325 | B2 | 7/2011 | Rash et al. |
| 2001/0052457 | A1 | 12/2001 | Woodruff et al. |
| 2002/0000372 | A1 | 1/2002 | Pedersen et al. |
| 2002/0029962 | A1 | 3/2002 | Stevens et al. |
| 2002/0053510 | A1 | 5/2002 | Woodruff |
| 2002/0160665 | A1 | 10/2002 | Krause et al. |
| 2003/0141185 | A1 | 7/2003 | Wilson et al. |
| 2003/0173209 | A1 | 9/2003 | Batz et al. |

(Continued)

OTHER PUBLICATIONS

Korean Intellectual Property Office, Search Report and Written Opinion for PCT/US2012/064938, Mar. 11, 2013.

*Primary Examiner* — Nicholas A Smith
*Assistant Examiner* — Ciel Thomas
(74) *Attorney, Agent, or Firm* — Kenneth H. Ohriner; Perkins Coie LLP

(57) ABSTRACT

An electro-processing apparatus includes a rotor in a head, and a contact ring assembly on the rotor. The contact ring assembly may have one or more strips of contact fingers on a ring base, with contact fingers clamped into position on the ring base. The strips may have spaced apart projection openings, with the projections on the ring base extending into or through the projection openings. A shield ring may be attached to the ring base, to clamp the contact fingers in place, and/or to provide an electric field shield over at least part of the contact fingers. The contact fingers may be provided as a plurality of adjoining forks, with substantially each fork including at least two contact fingers.

15 Claims, 6 Drawing Sheets

(56) References Cited

U.S. PATENT DOCUMENTS

| | | | |
|---|---|---|---|
| 2003/0196892 | A1 | 10/2003 | Batz et al. |
| 2004/0035694 | A1 | 2/2004 | Batz et al. |
| 2004/0149573 | A1 | 8/2004 | Herchen |
| 2004/0222086 | A1 | 11/2004 | Woodruff et al. |
| 2005/0045474 | A1 | 3/2005 | Zimmerman et al. |
| 2005/0061675 | A1 | 3/2005 | Bleck et al. |
| 2006/0191135 | A1 | 8/2006 | Ladd |
| 2006/0226000 | A1 | 10/2006 | Hanson et al. |
| 2006/0226019 | A1 | 10/2006 | Thompson et al. |
| 2006/0289302 | A1 | 12/2006 | Hanson |
| 2010/0155254 | A1 | 6/2010 | Prabhakar et al. |

* cited by examiner

CONTACT RING FOR AN ELECTROCHEMICAL PROCESSOR

TECHNICAL FIELD

The field of the invention is contact rings for making electrical contact to a substrate during electro processing.

BACKGROUND OF THE INVENTION

Electro processing microelectronic and similar work pieces, such as silicon wafers, typically involves immersing an electrically conductive surface on the device side of the work piece in an electrolyte. An electrical current path is established between an immersed electrode and electrical contacts touching the edges of the work piece. Metal ions in the electrolyte are deposited on the work piece (electroplating) or removed from the work piece (electro-polishing/etching).

As the microelectronic and other micro-scale devices are made ever smaller, the electrical contacts must meet greater performance specifications. Accordingly there is a need for improved electrical contacts in electro-processing systems.

SUMMARY OF THE INVENTION

An electro-processing apparatus includes a rotor in a head, and a contact ring assembly on the rotor. The contact ring assembly may have one or more strips of contact fingers on a ring base, with contact fingers clamped into position on the ring base. In one aspect, the strips may have spaced apart projection openings, with the projections on the ring base extending into or through the projection openings. A shield ring may be attached to the ring base, to clamp the contact fingers in place, and/or to provide an electric field shield over at least part of the contact fingers. The contact fingers may be provided as a plurality of adjoining forks, with substantially each fork including at least two contact fingers. If used, substantially each fork may have a head, a link on the head attached to an adjacent fork, and with the fingers attached to a shoulder joined to the head, or directly to the head without any shoulder on the fork.

The head is movable to position the contact ring assembly in the vessel and out of the vessel, to electro-plate or electro-polish a work piece, such as a silicon wafer or similar micro-scale device substrate.

DETAILED DESCRIPTION

Figure 1:
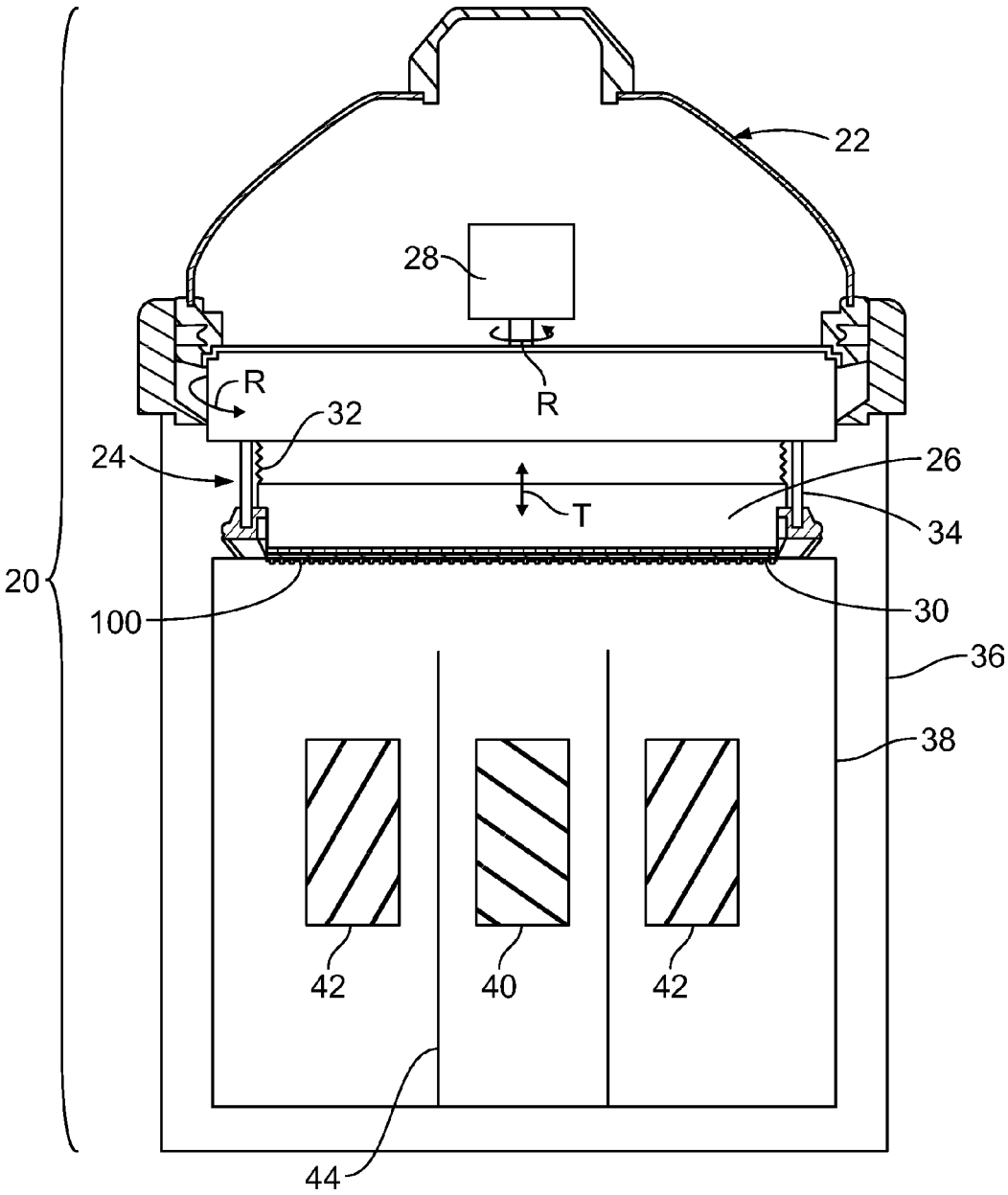
FIG. 1 is a schematic diagram of an electro-processing chamber.

As shown in FIG. 1, and electro processing chamber 20 has a head 22 including a rotor 24. A motor 28 in the head 22 rotates the rotor 24, as indicated by the arrow R in FIG. 1. A contact ring assembly 30 on the rotor 24 makes electrical contact with a work piece or wafer 100 held into or onto the rotor 24. The rotor 24 may include a backing plate 26, and ring actuators 34 for moving the contact ring assembly 30 vertically (in the direction T in FIG. 1 between a wafer load/unload position and a processing position. The head 22 may include bellows 32 to allow for vertical or axial movement of the contact ring while sealing internal head components from process liquids and vapors.

Referring still to FIG. 1, the head 22 is engaged onto a base 36. A vessel or bowl 38 within the base 36 holds electrolyte. One or more electrodes are positioned in the vessel. The example shown in FIG. 1 has a center electrode 40 and a single outer electrode 42 surrounding and concentric with the center electrode 40. The electrodes 40 and 42 may be provided in a di-electric material field shaping unit 44 to set up a desired electric field and current flow paths within the processor 20. Various numbers, types and configurations of electrodes may be used.

Figure 2:
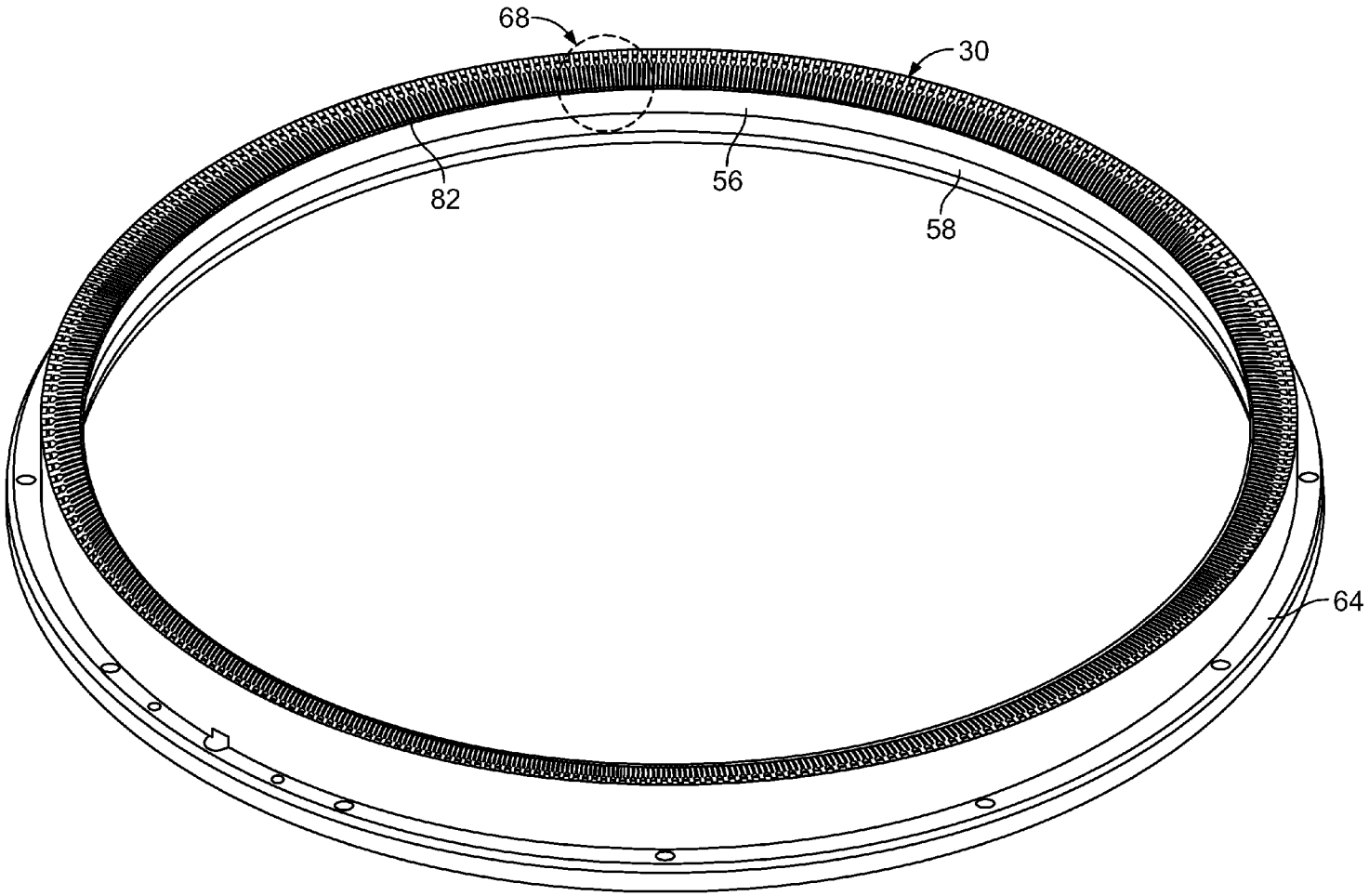
FIG. 2 is a perspective view of the contact ring shown in FIG. 1.

FIG. 2 shows the contact ring assembly 30 separated from rotor 24 and 15 inverted. Accordingly, the contact fingers 82 on the contact ring assembly 30 which are shown at or near the top of the contact ring assembly 30 in FIG. 2, are at or near the bottom end of the contact ring assembly 30 when the contact ring assembly 30 is installed into the rotor 24. A mounting flange 64 may be provided on the contact ring for attaching the contact ring assembly 30 to the rotor 24 with fasteners.

Figure 3:
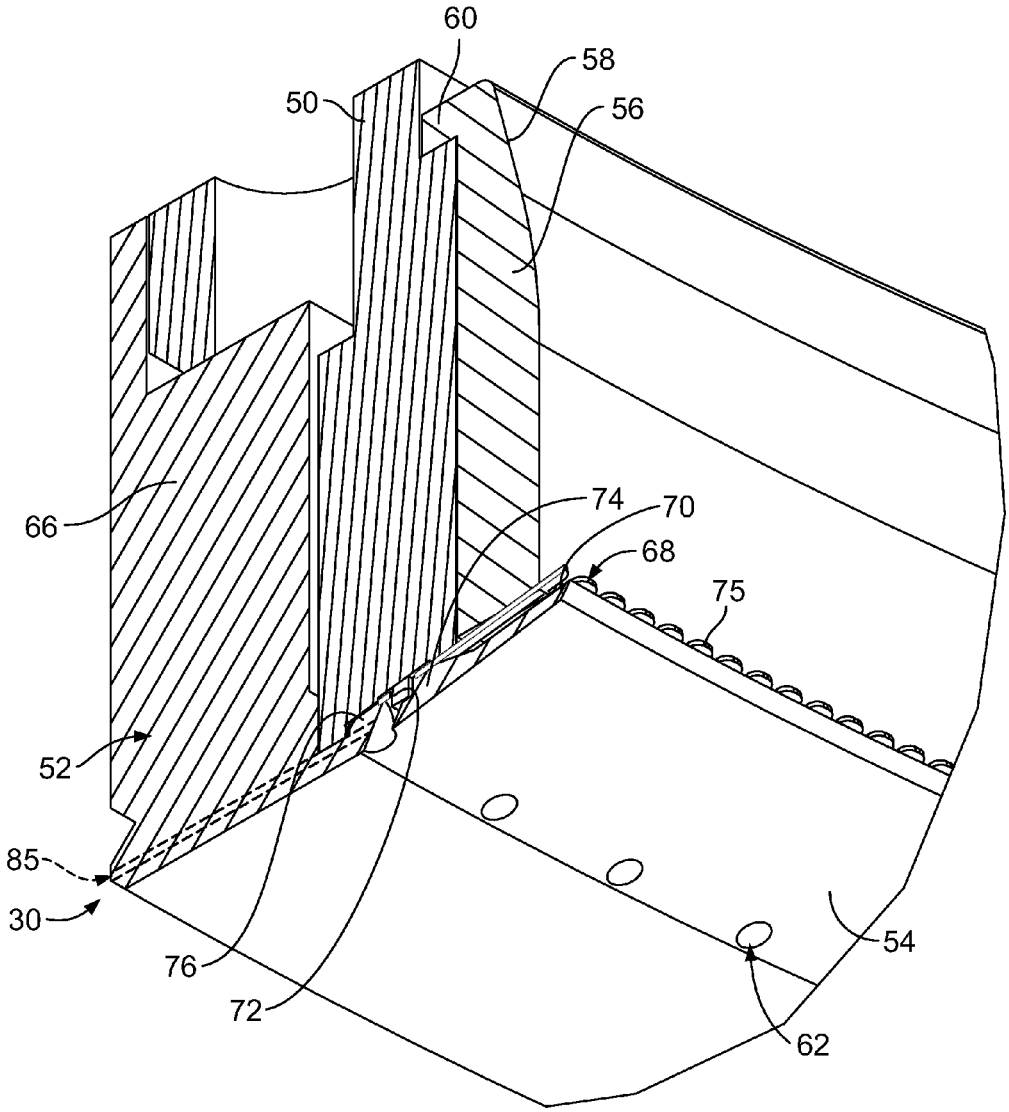
FIG. 3 is an enlarged section perspective view of the contact ring shown in FIGS. 1 and 2.
Figure 4:
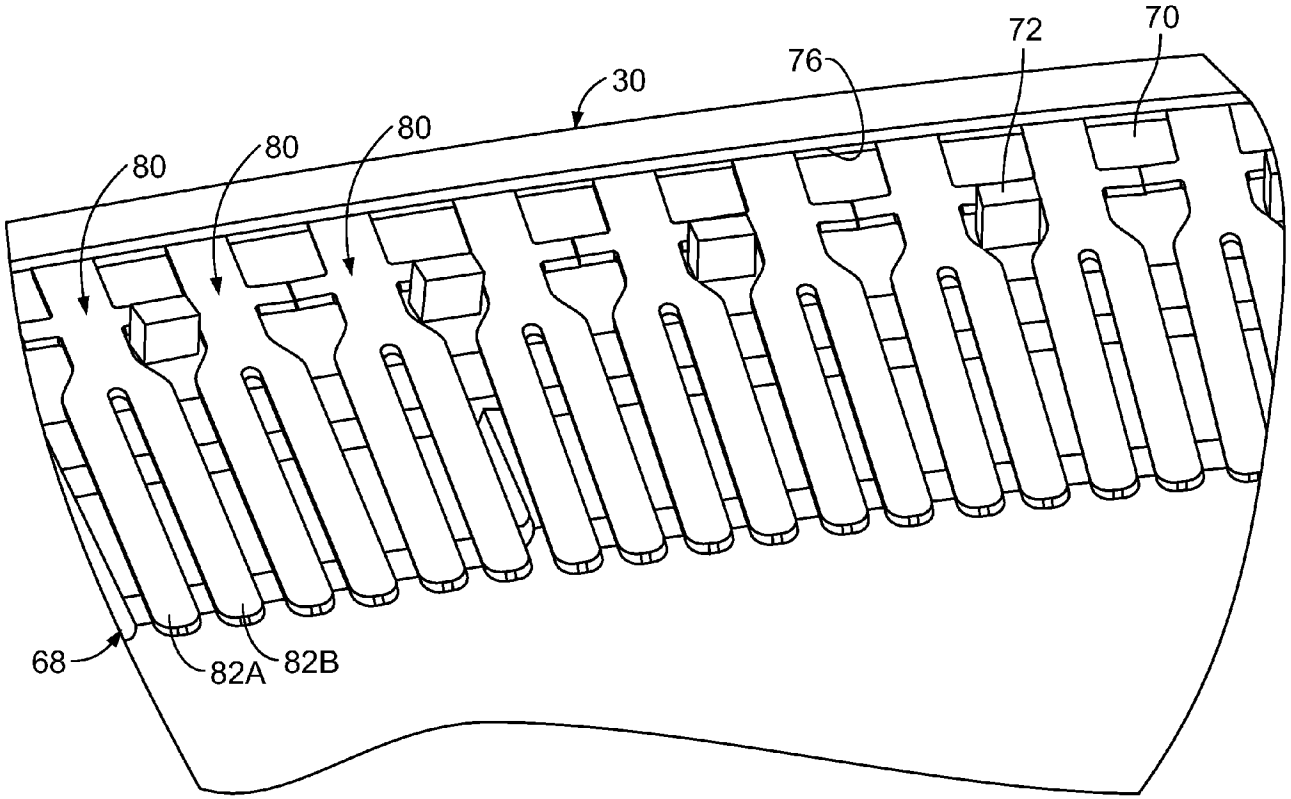
FIG. 4 is an enlarged bottom perspective detail view of the contact ring.

FIG. 3 shows a section view of the contact ring assembly 30, with the contact ring once again in the installed upright orientation shown in FIG. 1. In this example, the contact ring assembly 30 has a base ring 50 between an inner liner 56 and an outer shield ring 52. Referring now also to FIG. 4, lines or strips of contact fingers 82 are attached to the ring base 50. The contact fingers 82 may be positioned onto a flat angled bottom surface 70 of the ring base 50. Consequently, the fingers 82 extend inwardly (towards the center of the contact ring assembly 30) and also slightly upwardly in FIGS. 1 and 3. Alternatively, the bottom or mounting surface 70 may be horizontal, or even inclined downwardly.

Figure 7:
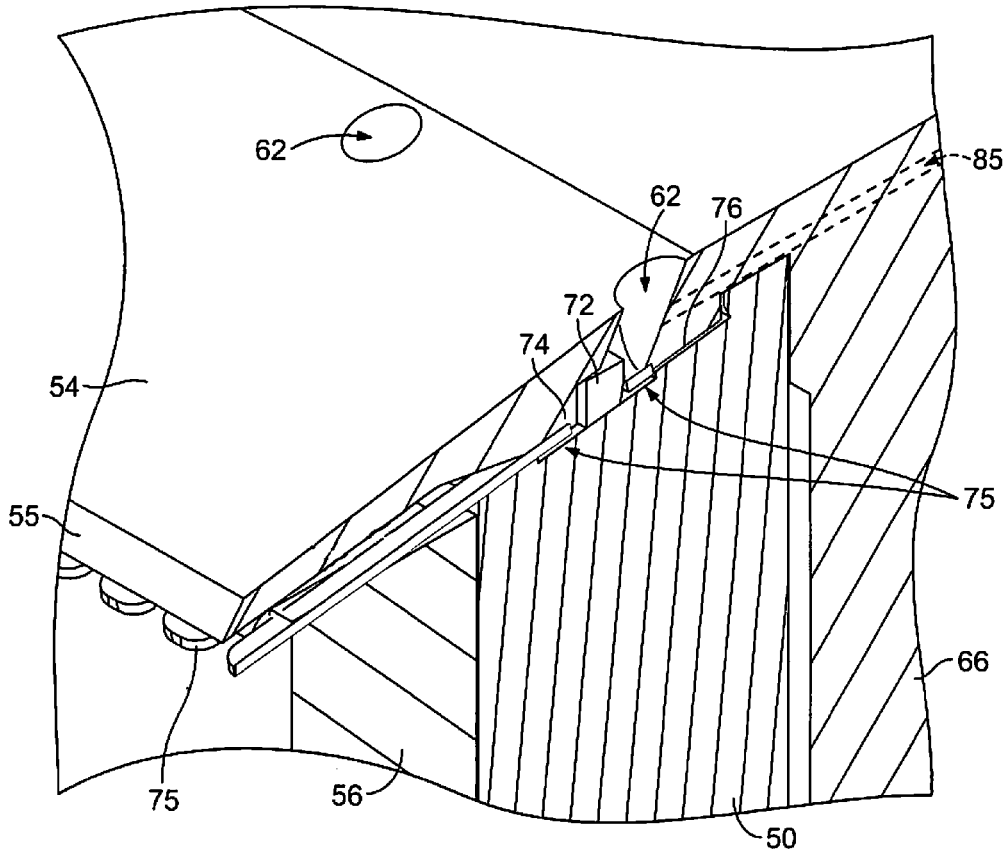
FIG. 7 is a further enlarged inverted view of the contact ring and shield shown in FIG. 3.

A shield 54, if used, covers part of or the entire length of contact fingers 82. In FIG. 3, only the innermost tips 75 of the fingers 82 are not covered or shielded by the shield 54. The inwardly extending length of the shield 54, relative to the length of the fingers 82, may be adjusted to vary the current thieving effect of the fingers. In some to designs, the shield may extend inwardly past the tips of the fingers 82, so that the fingers are completely shielded from below. Alternatively, the tips 75 of the fingers may extend radially inwardly past the inner edge of the shield 54 by 1 to 10, 2 to 5 or 2 to 8, or 3-7 mm. Rinse holes 62 may be provided in the shield 54 to better allow for cleaning and deplating of the forks 80. If the contact ring 30 is used in a sealed ring design (a so-called dry contact ring), then the rinse holes 62 may be omitted since the electrolyte does not come into contact with the forks 80 in a sealed ring design. As shown in FIGS. 3 and 7, rinse holes 85 may extend inwardly through the ring section 66, in place of, or in addition to, the rinse holes 62. Locating the rinse holes through the outside diameter of the ring section, instead of positioning the rinse holes under the back end of the fingers, reduces the influence of the drain holes on the electric field during processing. The rinse holes 85 may optionally be located higher up on the ring section 66, so that they remain above the plating bath at all times.

The shield 54 is made of a di-electric material and may be formed as part of the shield ring 52. Alternatively, the shield 54 may be a separate ring attached to the contact ring assembly 30. The ring base 50 may be made of metal, such as titanium. The shield ring 52 may include a ring section 66 and an attached or integral shield or shield section 54. As shown in FIG. 7, the shield 54 may have an inner edge 55 oriented an acute angle to vertical, e.g., to the rotation axis T of the rotor as shown in FIG. 1. Also as shown in FIG. 7, a gap 75 may be provided between the shield 54 and the fingers in the unloaded condition. The gap 75, if used, may close up when a wafer is loaded into the rotor 24 and the contact ring 30 is moved up (as shown in FIGS. 1 and 3) to make electrical contact with the wafer and to hold the wafer in place for processing.

The fingers 82 are electrically connected to the processor electrical system. This electrical connection may be achieved via an electrically conductive ring base 50, e.g., with the ring base made partially or entirely of metal. Alternatively, the ring base 50 may also be an electrically non-conductive material or dielectric material, with one or more electrical leads extending through or alongside the ring base 50, to electrically connect with the fingers 82. The inner liner 56 may have an outwardly tapering surface 58, to help to guide and center a wafer 100 into the contact ring assembly 30. The inner liner 56, which is generally plastic or another non-conductive material, may have an outwardly extending lip 60 that extends into a slot or recess in the ring base 50.

Figure 5:
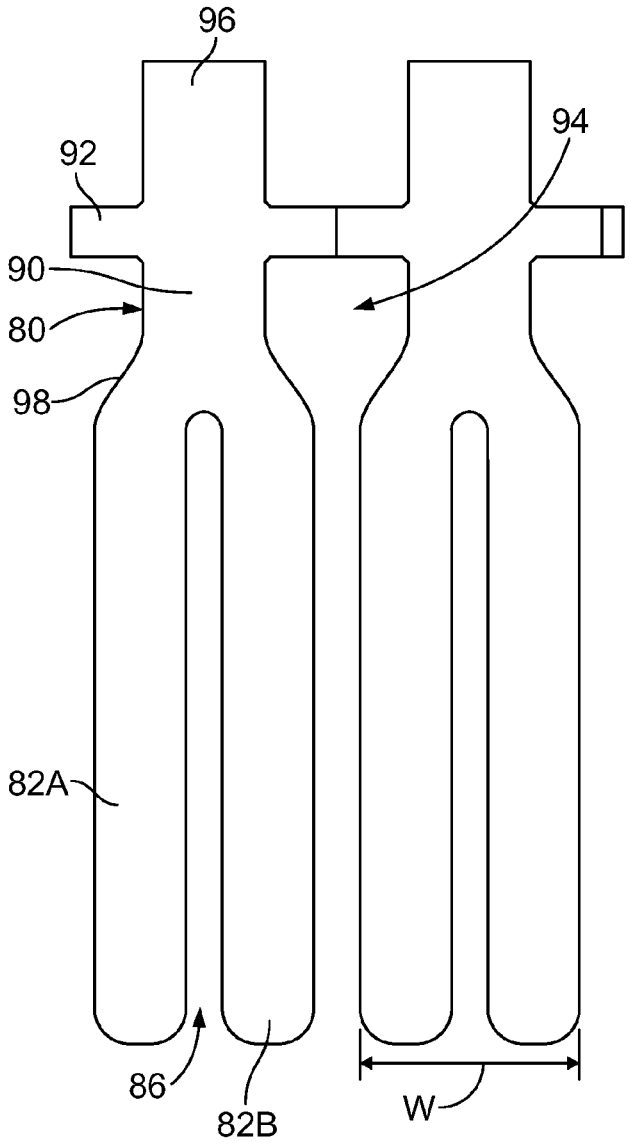
FIG. 5 is an enlarged plan view of two of the side-by-side contacts shown in FIG. 4.
Figure 6:
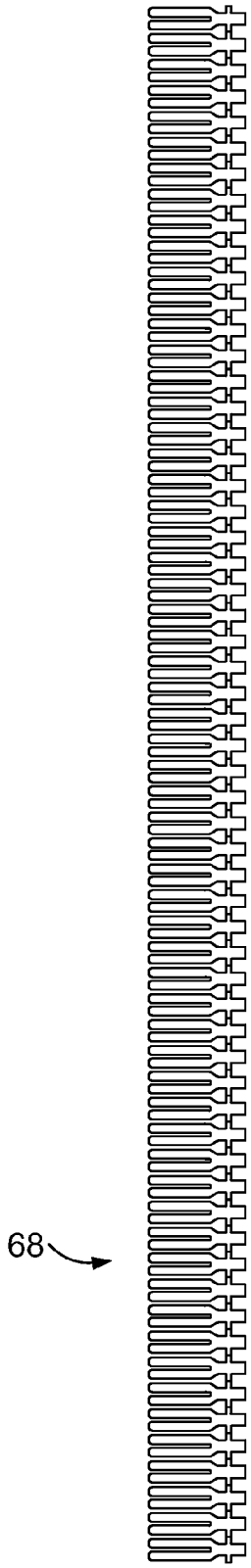
FIG. 6 is an enlarged plan view of a strip of contacts.

Turning to FIGS. 4-6, the fingers 82 may be provided on a strip 68 of connected forks 80, with each fork 80 including two fingers, indicated as 82A and 82B. Lugs, pins or other protrusions 72 may be spaced apart on the angled or conical surface 70 of the ring base 50, with the lugs 72 extending into or through a lug gap or opening 94 between adjacent forks 80. As shown in FIGS. 4 and 5, each fork 80 may include a head 96 having links 92 on each side connected to adjacent forks. The fingers 82A and 82B of each fork 80 may be joined to a fork neck section 90 having a width about the same as the width of the head 96. In this design as shown, the upper or outer ends of the fingers 82A and 82B slant or curve inwardly at a shoulder 98.

The fingers 82A and 82B of each fork 80 are parallel and spaced apart by a gap 86, with the fingers having a width 2-5 times greater than the width of the gap 86. For example, the fingers may a width of about 0.020 to 0.050 inches and the gap 86 may have a width of about 0.010 to 0.020 inches. Referring to FIG. 5, each fork 80 may have a width W of from about 0.06 to 0.120 or 0.070 to 0.100 inches. With dimensions in these ranges, far more fingers can fit onto the contact ring assembly 30 in comparison to existing designs. For example, a contact ring assembly 30 for use with a 12 inch diameter wafer may have 480 or even 720 fingers. Providing a large number of contacts may reduce adverse effects, such as current path variations and heating, when plating onto extremely thin seed layers. If desired, the fingers may be made even narrower, for example with three, four or more fingers on each fork 80, resulting in designs having over 1000 fingers. A similar or the same gap 86 may be provided between the fingers of adjacent forks. The fingers 82A and 82B may be mirror images of each other, having the same size and shape. The finger thickness may vary depending on the finger material, and the finger length. The fingers shown in FIG. 5 have a length of about 0.25 inches, measured from the inner tip to the outer root of the gap 86. Using platinum, platinum/iridium alloy, or platinum coated titanium, finger thicknesses ranging from about 0.005 to 0.010 inch are typical.

Referring now to FIG. 6, strips or ribbons 68 of forks 80 may be made using various manufacturing techniques, such as electro discharge machining, or stamping a metal sheet, such as titanium with or without a platinum or iridium cladding. With the ring base 50 up-side down, the strips 68 are positioned on the surface 70, with the lugs 72 positioning the strips 68. Specifically, the outer or upper edge of the fork head 96 is positioned against a concentricity alignment rim or lip 76 of the ring base 50, causing the fingers to align precisely concentrically on the base ring. The lugs 72 may also help to position the fingers concentrically, as well as laterally. Although a single continuous strip 68 may be used, manufacture and assembly may be simplified by using multiple shorter strips.

Referring to FIG. 3, with the strips 68 in place, shield ring 52, including the shield 54, is placed over the ring base 50, with the now down-facing surface of the shield 54 in contact with the strips 68. The shield ring 52 is then clamped onto the ring base 50 via fasteners, such as cap screws. Inner and outer rings 74 and 72 on the down-facing surface of the shield press on the shoulders 98 and head 96 of the forks 80, clamping the forks 80 in place, largely flat against and parallel to the surface 70.

The liner 56 is attached to the ring base 50 e.g., with fasteners. The liner 56 guides the wafer 100 into a processing position within the contact ring assembly 30. Since both the liner 56 and the fingers 82 are positioned via surfaces of the ring base 50, the fingers 82 may concentric with the wafer 100 to a high degree of precision. Holding the fingers 82 in place purely via clamping, as opposed to using known techniques such as pressing or welding, allows simplified manufacturing. It also allows the fingers to be made of precious metals, for longer contact life, because the fingers may be formed from unstressed metal sheet stock.

Although the strips 68 may be straight, links 92 between the forks allow the strips 68 to bend to conform to the circumference of the ring base 50, and to the conical section of the surface 70, if any. With this assembly, the fingers are automatically accurately and securing positioned. No positioning or bending of individual contacts is needed. The fingers are automatically positioned precisely concentric with the ring base 50. This allows for plating highly uniform layers. The fingers may also be easily replaced when damaged or worn, as no welding, coating, or other repair steps are needed. Correspondingly, fingers made of precious metal may also be easily separated from the contact ring assembly 30 for collection.

The contact ring assembly 30 may be used in wet contact applications where the fingers are in contact with the electrolyte. In this type of application, the shield 54 reduces the build up of metal plated onto the fingers. This improves the performance of the plating chamber 20 and reduces the time required for contact finger de-plating. The shield 54 may be used with the finger contacts 82, or with conventional contact fingers. The contact ring assembly 30 may also be used in sealed ring or dry contact applications. In a sealed ring design, a seal on the rotor seals the electrolyte away from the outer edges of the wafer. The fingers make electrical contact with a seed layer or other pre-existing conductive layer on the wafer, but do not come into contact with the electrolyte.

Thus, novel methods and designs have been shown and described. Various changes, substitutions and use of equivalents may of course be made, without departing from the spirit and scope of the invention. The invention, therefore, should not be limited, except to the following claims and equivalents of them.

What is claimed is:

1. Electro-processing apparatus comprising:

a head;

a rotor in the head;

a contact ring on the rotor;

a plurality of spaced apart projections on the contact ring;

one or more strips of flat contact fingers clamped into position on the contact ring, with the strips having a plurality of spaced apart projection openings, and with the projections extending into or through the projection openings, and with strips comprising a plurality of adjoining forks, with each fork including at least two contact fingers having parallel sides; and a base including an electrolyte vessel, with the head movable to position the contact ring in the vessel and out of the vessel.

2. The electro-processing apparatus of claim 1 with substantially each fork including a head, a link on the head attached to an adjacent fork, and with the fingers attached to a Y-shaped shoulder joined to the head.

3. The electro-processing apparatus of claim 2 with one or more forks having two contact fingers separated by a uniform width gap, and with the two contact fingers each having a width 2-4 times greater than the uniform width of the gap.

4. The electro-processing apparatus of claim 1 further comprising an annular di-electric material shield at least partially overlying the contact fingers.

5. The apparatus of claim 1 with the contact ring on the rotor including a ring base, and with the contact fingers formed of unstressed metal sheet stock, without bending; and a shield ring at least partially overlying the contact fingers and an outer surface of the ring base.

6. The apparatus of claim 5 with the shield ring spaced apart from the contact ring and having an inner shield section and an outer ring section, and with the inner shield section covering the fingers and the outer ring section surrounding the ring base.

7. The apparatus of claim 5 further comprising a liner on an inner surface of the ring base, with the shield ring and the liner comprising a non-metal, and with the ring base comprising metal.

8. The apparatus of claim 7 with the liner including a tapering upper surface.

9. The apparatus of claim 5 wherein the strips of contact fingers are flat and are clamped between a flat surface of the shield ring and a flat surface of the ring base.

10. The apparatus of claim 5 with each fork having a fork head, and with an outer end of fork head positioned against an annular concentricity alignment lip on the ring base.

11. The apparatus of claim 1 with the contact ring having at least 360 fingers.

12. The apparatus of claim 1 wherein the fingers are flat and have a thickness of about 0.005 to 0.010 inch.

13. A contact ring assembly for use in an electro processing apparatus, comprising:

a metal ring base having an inner wall, and outer wall, and a flat angled surface;

a plurality of spaced apart lugs on the flat angled surface;

one or more strips of flat contacts comprising equally spaced apart metal forks, with each fork having a head, left and right side links on the head attached to and extending perpendicular to adjacent forks, and two or more fingers attached to the head of each fork with the fingers having parallel sides, with the strips on the flat angled surface of the metal ring base, and with the lugs extending into openings in the strips; and a non-metal shield ring attached to the metal base ring, with the shield ring having a shield section holding the strips onto the flat angled surface, and with the shield ring also having a ring section around the outer wall of the metal base ring.

14. The electroprocessing apparatus of claim 13 further comprising a plurality of spaced apart rinse holes in the shield.

15. The contact ring assembly of claim 13 further comprising a non-metal liner on the inner wall of the ring base.

* * * * *